US006196127B1

(12) United States Patent
Yamamoto et al.

(10) Patent No.: US 6,196,127 B1
(45) Date of Patent: Mar. 6, 2001

(54) SCREEN PROCESS PRINTING METHOD AND SCREEN PRINTING MACHINE

(75) Inventors: Kazuhisa Yamamoto; Tomoaki Ishiura; Tomohito Shimizu, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/166,628

(22) Filed: Oct. 5, 1998

(30) Foreign Application Priority Data

Oct. 7, 1997 (JP) ..... 9-289239

(51) Int. Cl.[7] ..... B41M 1/12
(52) U.S. Cl. ..... 101/129; 101/120
(58) Field of Search ..... 101/116, 117, 101/118, 129, 123, 124, 228, 232, 424.1, 120

(56) References Cited

U.S. PATENT DOCUMENTS 5,572,928 * 11/1996 Negishi ..... 101/116
5,667,618 9/1997 Lowther .
5,791,247 * 8/1998 Kolb ..... 101/232

FOREIGN PATENT DOCUMENTS 2699450 6/1994 (FR) .
9703839 2/1997 (WO) .

* cited by examiner

*Primary Examiner*—Ren Yan
(74) *Attorney, Agent, or Firm*—Cooper & Dunham LLP

(57) ABSTRACT

A screen process printing method of performing solid printing on a printing substrate with a printing ink, using (a) a squeegee, (b) a screen pattern plate through which the printing ink is brushed or squeezed so as to form a solid ink transferred portion on the printing substrate by the squeegee which is in contact with the screen pattern plate, with the screen pattern plate coming into contact with the printing substrate and separating therefrom, (c) a back-up roller which is disposed so as to be directed to the screen pattern plate and the squeegee, and around which the printing substrate is wound, and (d) a gas ejection slit from which a gas is ejected, includes a step of ejecting the gas from the gas ejection slit toward a separate portion at which the printing substrate separates away from the screen pattern plate, thereby smoothing the surface of the solid ink transferred portion on the printing substrate, and a screen printing machine for carrying out this screen process printing method is provided.

8 Claims, 4 Drawing Sheets

SCREEN PROCESS PRINTING METHOD AND SCREEN PRINTING MACHINE

BACKGROUND OF THE INVENTION

1. Field of the Invention

The present invention relates to a screen process printing method of performing solid printing with a printing ink on a printing substrate such as a paper sheet, a film or a metallic foil, using a screen pattern plate through which the printing ink is brushed or squeezed onto the printing substrate by a squeegee, and a screen printing machine for performing the screen process printing method, which can be used for the sublimation type ink ribbon, batteries, and scratch cards.

2. Discussion of Background

Conventionally, when a screen process printing method is employed in the production of color ribbons such as a thermosensitive recording ribbon and a sublimation type ink ribbons, a printing ink is applied to a screen pattern plate which include opening portions in the same pattern as a solid image pattern to be printed as shown in FIG. 4 and is brushed or squeezed through the screen pattern plate onto a printing substrate such as a paper sheet, a film or a metallic foil which comes into contact with the screen pattern plate, using a squeegee which is brought into pressure contact with the screen pattern plate, whereby a solid printed pattern is obtained as desired.

Usually, the printing ink for use in color printers for the production of thermosensitive recording ribbons and sublimation type ink ribbons has a high viscosity in a range of 5,000 to 20,000 mPa.s, so than when the printing speed (that is, the transportation speed of the printing substrate such as a paper sheet or a film) is increased, printing defects are caused in printed image areas, such as lack of surface smoothness in the printed image area with an uneven or wavy printed surface, the trailing of rear end portions of printed images, the smearing of printed areas, due to the filamenting and misting of the printing ink.

In the case of printing ribbons which are produced by the screen process printing method, using the printing ink, the lack of surface smoothness would directly cause the lowering of the printed image quality that can be obtained by the printing ribbons, so that high smoothness is required and demanded for the surface of such printing ribbons. In the case of color printing ribbons, printing is continuously performed using three or four yellow, cyan, magenta and/or black rectangular patterns. However, the above-mentioned problems such as the filamenting and the misting of the printing ink must be avoided, since such problems would cause the smearing of adjacent color patterns and the above-mentioned printed image defects.

The mechanisms of the occurrence of the filamenting and the misting of the printing ink have not yet been clarified. However, it is considered that the filamenting of the printing ink is caused by forming a thread with the aggregation of several ink droplets which pass through ink passing holes or openings of the screen pattern plate, or by the formation and growth of bubbles in the printing ink with a reduction in an inner pressure of the printing ink immediately before the breakup or fragmentation of the printing ink, and a successive non-uniform reduction in the inner pressure of the printing ink in the direction of the width of the screen plate, and that the filamenting of the printing ink causes the misting of the printing ink.

In order to prevent the occurrence of the filamenting and the misting of the printing ink, the humidity of the ambient printing atmosphere is empirically controlled, and conductive materials for increasing the conductivity of the printing ink and other various compounds are added to the printing ink.

However, in the case of thermosensitive recording ribbons, sublimation type ink ribbons, and batteries, each printed area is required to have its own particular functional quality, so that in many cases, various compounds cannot be added to the printing ink, and therefore the occurrence of the filamenting and the misting of the printing ink is prevented inevitably, for instance, by reducing the printing speed.

However, this is not an efficient method, in particular, for producing a thermosensitive recording ribbon, a sublimation type ink ribbon, batteries, and scratch cards.

SUMMARY OF THE INVENTION

It is therefore a first object of the present invention to provide a screen process printing method of performing solid printing on a printing substrate with a printing ink with high productivity, which is free of the conventional problems of (a) insufficient uniformity in a coated surface with convex and concave portions or large waviness as illustrated in FIG. 7 in which reference numeral 4 indicates a printing substrate and reference numeral 9 indicates a convex, concave or wavy printed surface, and (b) a reduction in the yield of the production thereof due to printing defects with the deposition of a printing ink on the printing substrate or printed image pattern. The insufficient uniformity in the course of a printing process for the reproduction of a thermosensitive recording ribbon or a sublimation type ink ribbon when the printing speed is increased by increasing the transportation speed of the printing substrate such as paper, a film or metallic foil, and the reduction in the yield of the production of the thermosensitive recording ribbon or the sublimation type ink ribbon is caused by the filamenting of a rear portion of a printed image pattern or the misting of the printing ink.

A second object of the present invention is to provide a screen printing machine for carrying out the above-mentioned screen process printing method.

The first object of the present invention can be achieved by a screen process printing method of performing solid printing on a printing substrate with a printing ink, using (a) a squeegee, (b) a screen pattern plate through which the printing ink is brushed or squeezed so as to form a solid ink transferred portion on the printing substrate by the squeegee which is in contact with the screen pattern plate, with the screen pattern plate coming into contact with the printing substrate and separating therefrom, (c) a back-up roller which is disposed so as to be directed to the screen pattern plate and the squeegee, and around which the printing substrate is wound, and (d) a gas ejection slit from which a gas is ejected, comprising a step of ejecting the gas from the gas ejection slit toward a separation portion at which the printing substrate separates away from the screen pattern plate, thereby smoothing the surface of the solid ink transferred portion on the printing substrate.

In the above-mentioned screen process printing method, it is preferable that the gas be ejected with a gas ejection pressure of 3 to 200 mmaq. The abbreviation "mmaq" stands for mm-aqua (1 mmaq=$1/10{,}000$ kg/cm$^2$).

It is also preferable that the gas ejection slit have a slit gap of 0.3 to 5 mm, with a top end of the gas ejection slit being disposed at a distance of 14 to 50 mm from a contact point of the screen pattern plate with the printing substrate.

It is also preferable that the above-mentioned screen process printing method further comprise a step of electrically neutralizing the printing ink when the printing substrate is separated away from the screen pattern plate.

It is also preferable that in the above-mentioned screen printing method, the gas further comprise an ionized component capable of electrically neutralizing the printing ink when the printing substrate is separated away from the screen pattern plate.

It is also preferable that in the above-mentioned screen printing method, the gas further comprise a component capable of preventing the drying of said printing ink, such as a vaporized organic solvent, an aqueous vapor, and/or a mixture thereof.

The second object of the present invention can be achieved by a screen printing machine for performing solid printing on a printing substrate with a printing ink, comprising:

a squeegee;

a screen pattern plate through which the printing ink is brushed or squeezed so as to form a solid ink transferred portion on the printing substrate by the squeegee which is in contact with the screen pattern plate, with the screen pattern plate coming into contact with the printing substrate and separating therefrom, a back-up roller which is disposed so as to be directed to the screen pattern plate and the squeegee, and around which the printing substrate is wound, and a gas ejection slit from which a gas is ejected toward a separation portion at which the printing substrate separates away from the screen pattern plate, thereby smoothing the surface of the solid ink transferred portion on the printing substrate.

It is preferable that in the above screen printing machine, the gas be ejected from the gas ejection slit with a gas ejection pressure of 3 to 200 mmaq.

It is also preferable that in the above screen printing machine, the gas ejection slit have a slit gap of 0.3 to 5 mm, with a top end of the gas ejection slit being disposed at a distance of 14 to 50 mm from a contact point of the screen pattern plate with the printing substrate.

It is also preferable that the above screen printing machine further comprise an ion generator which is capable of ionizing at least part of the gas ejected from the gas ejection slit, or generating an ionized component in the gas, thereby electrically neutralizing the printing ink when the printing substrate is separated away from the screen pattern plate.

It is also preferable that in the above screen printing machine, the gas further comprise an ionized component capable of electrically neutralizing the printing ink when the printing substrate is separated away from the screen pattern plate.

It is also preferable that in the above screen printing machine, the screen pattern plate be a cylindrical screen plate, and that the squeegee be disposed inside the cylindrical screen pattern plate, with the cylindrical screen pattern plate being continuously rotated in synchronism with the printing substrate, through which cylindrical screen pattern plate the printing ink is brushed or squeezed onto the printing substrate by the squeegee, with the screen pattern plate and the squeegee being disposed so as to be in contact with each other.

It is also preferable that in the above screen printing machine, the gas comprises a component capable of preventing the drying of the printing ink, such as a vaporized organic solvent, an aqueous vapor, and/or a mixture thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
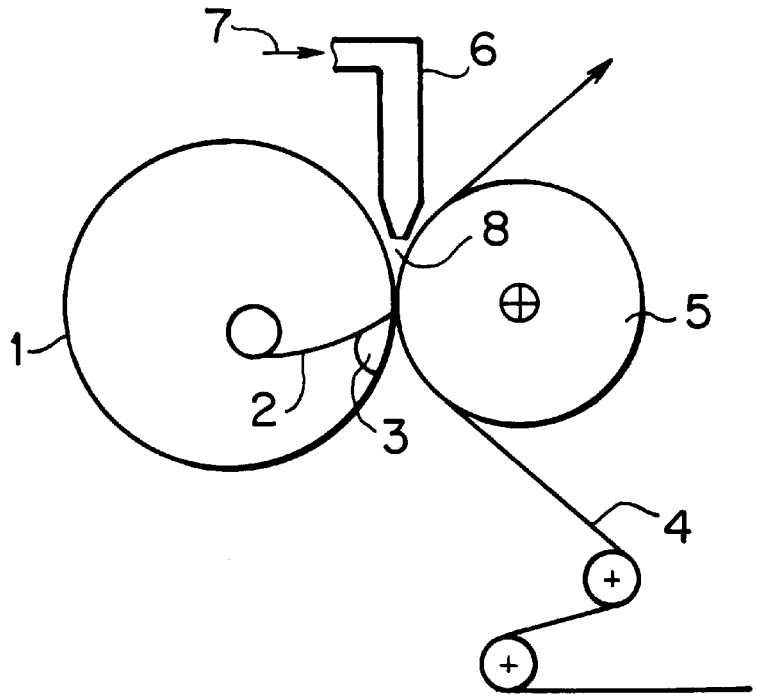
FIG. 1 is a schematic cross-sectional side view of a rotary screen printing machine of the present invention.

With reference to the accompanying drawings, wherein like reference numerals designate identical or corresponding parts throughout the several views, the present invention will now be explained, taking as an example a rotary screen printing machine, even though the present invention is useful for various kinds of screen printings.

FIG. 1 is a schematic cross-sectional side view of a rotary screen printing machine of the present invention.

As shown in FIG. 1, the rotary screen printing machine comprises a rotary screen pattern plate 1, a squeegee 2, an ink reservoir portion 3, a printing substrate 4, a back-up roller 5, and an air blowing nozzle slit 6 serving as the above-mentioned gas ejection slit. Air supplied via an air supply inlet 7 form an air supply source (not shown) is ejected from a top outlet portion of the air blowing nozzle slit 6 so as to blow against a separation portion 8 at which the printing substrate 4 is separated from the rotary screen pattern plate 1.

Figure 4:
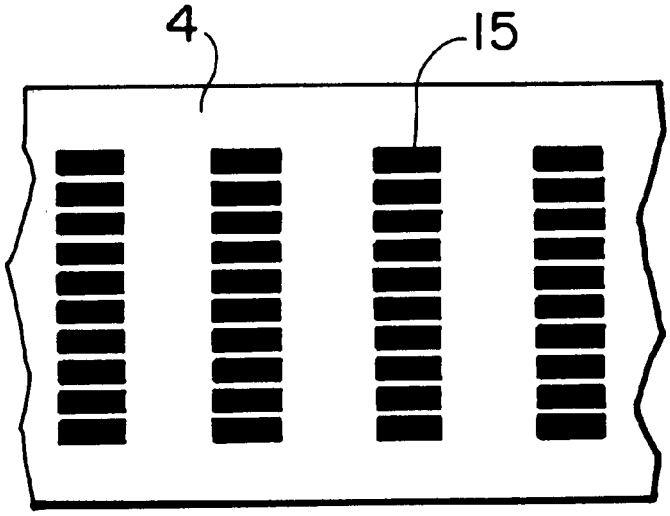
FIG. 4 is an example of a printed material produced by the rotary screen printing machine.

By such a rotary screen printing machine, for instance, a printed material comprising solid rectangular printed patterns 15 as shown in FIG. 4 is produced.

Figure 5:
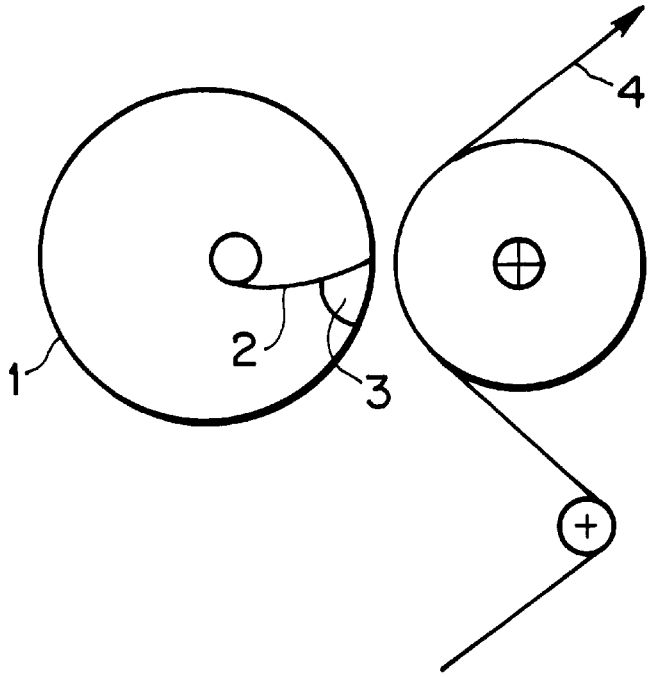
FIG. 5 PRIOR ART
FIG. 5 is a schematic cross-sectional side view of a conventional rotary screen printing machine.
Figure 6:
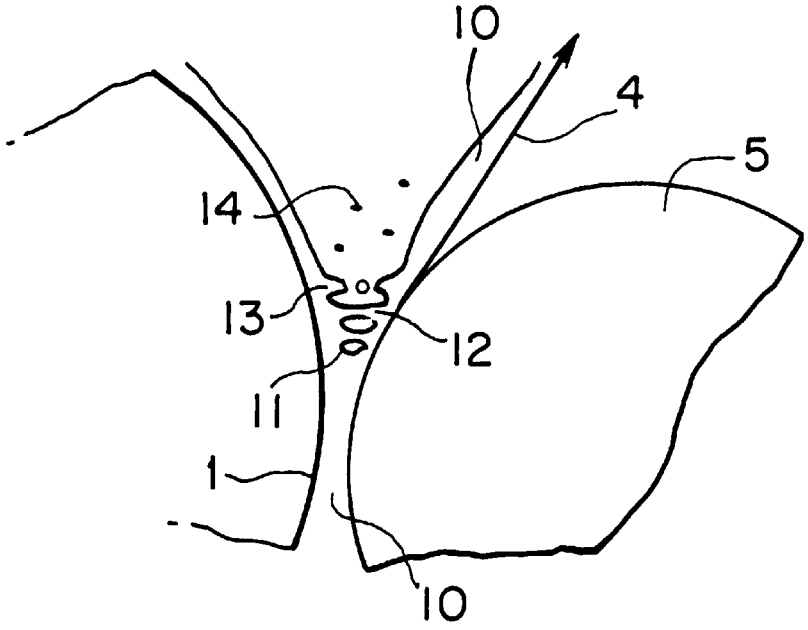
FIG. 6 PRIOR ART
FIG. 6 is a schematic cross-sectional view of a printing outlet portion of the conventional rotary screen printing machine as shown in FIG. 5 in explanation of the occurrence of the misting of a printing ink at the printing outlet portion thereof.
Figure 7:
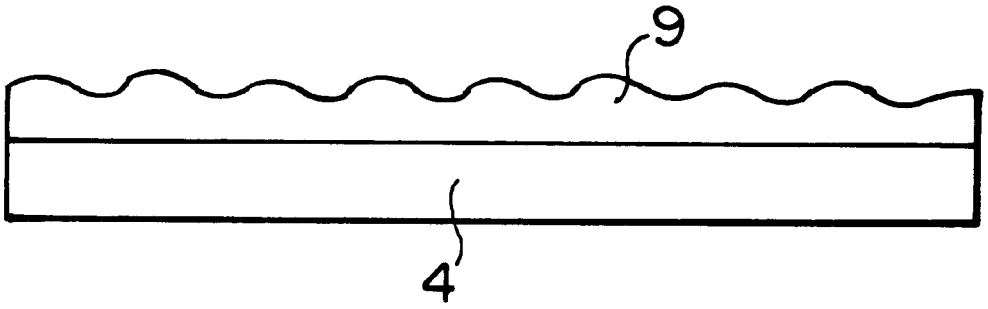
FIG. 7 is a schematic cross-sectional view of a printed coated surface with convex and concave portions or with waviness.

In such a conventional rotary screen printing machine as shown in FIG. 5, a printing ink 10 at an outlet printing portion is pulled and ruptured separately at a rupture point 13 with the formation of vacant portions 11 by both the rotary screen pattern plate 1 and the printing substrate 4, so that a filament 12 of the printing ink 10 is formed as shown in FIG. 6. This phenomenon is called "filamenting of the ink". When this phenomenon takes place, the flatness of the coated surface formed by the printing on the printing substrate 4 is significantly reduced with the formation of convex and concave portions or large waviness in the coated surface.

Figure 8:
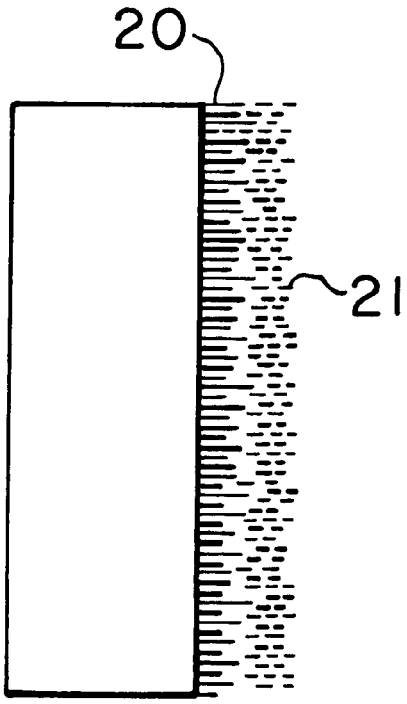
FIG. 8 is a schematic plan view of a rectangular printed pattern printed with an ink ribbon, with the occurrence of the filamenting and misting of the ink of the ink ribbon.

Furthermore, when the filament of the printing ink 10 is broken and ink droplets 14 are formed, the formed ink droplets 14 are scattered, and the misting of the ink takes place, with the deposition of the ink droplets 14 not only on printed image areas, but also on non-printed image areas of the printing substrate 4. Thus, the filamenting and the misting of the ink cause printing defects as shown in FIG. 8, in which reference numeral 20 indicates the filaments of the printing ink 10, and reference numeral 21 indicates misted ink droplets of the ink 10, which degrade the printing quality.

The mechanism of the occurrence of the filamenting of the printing ink has not yet been clarified. However, it is considered that the filamenting of the printing ink is caused by the formation of a thread with the aggregation of several ink droplets which pass through ink passing holes or openings formed in the rotary screen plate, or by the formation and growth of bubbles in the printing ink with a reduction in an inner pressure of the printing ink immediately before the breakup or fragmentation of the printing ink, and by the inner pressure of the printing ink becoming non-uniform in the direction of the width of the screen plate.

The filamenting of the printing ink can be significantly reduced by breaking the above-mentioned thread of ink droplets with an air-knife effect produced by a dynamic pressure of air which is caused to blow thereto. The filamenting of the printing ink can also be significantly reduced by causing air to blow toward the printing outlet portion, since the blowing of air to the printing outlet portion makes it possible to control (a) the reduction in the inner pressure of the printing ink immediately before the rupture of the printing ink, with the separation thereof to the printing substrate and to the rotary screen plate, and (b) the formation of bubbles in the printed ink and the formation of bubbles in the printing ink by the reduction in the inner pressure of the printing ink immediately before the rupture of the printing ink by the air which accompanies the printing substrate and the rotary screen. This can be discovered by a computer simulation.

The result is that convex and concave portions and waviness can be removed from the coated surface, so that the flatness of the coated surface is significantly improved. In addition, the occurrence of the misting of the printing ink, which is caused by the growth of the filamenting of the printing ink, can also be significantly reduced.

It has been confirmed that the above-mentioned filamenting and misting effect can also be obtained by suction.

In the present invention, the ejecting direction of the gas from the gas ejection slit can be adjusted so as to make smoothest or appropriately smooth the surface of the printing ink deposited on the printing substrate.

A mixed air comprising an organic solvent gas and/or water vapor may be caused to blow. When the printing ink is a solvent-based ink, the clogging of the screen plate, which occurs when dried in the course of the air blowing, can be prevented by causing a mixed air comprising an organic solvent vapor to blow. Furthermore, by covering a printing section of a printing machine with a sealing cover, the screen plate can be prevented from being dried, so that the clogging of the screen plate can be effectively prevented.

The present invention can be effectively applied to various screen printing methods and is capable of attaining high speed printing when applied to a rotary screen printing method, a cylinder press printing method, and a lithographic screen printing method. In particular, the present invention is capable of forming high quality printed film layer at high speed when combined with the rotary screen printing method.

It is preferable that the printing ink for use in the present invention have a viscosity in a range of 500 to 30,000 mPa.s in order to effectively attain the objects of the present invention, in particular, high speed printing. However, when the printing ink has a viscosity as low as 500 to 5000 mPa.s, high quality printing can be effectively performed at high speed.

When a printed coated layer with surface properties completely free of non-uniform density, concave and convex portions and waviness is strictly demanded, for instance, for use as a printing layer on the surface of batteries, it is preferable to perform pressing the printed surface of a printing substrate, using various kinds of roll-shaped or plate-shaped pressing machines.

When the thread of ink droplets is broken and ink droplets are formed again, it may occur that the thus formed ink droplets are electrostatically scattered. Such scattering of the ink droplets can be prevented when an air gas comprising ionized air is used, since the electrostatically charged ink droplets are electrically neutralized by the air gas comprising ionized air. Furthermore, the occurrence of the filamenting and misting of the printing ink can be reduced when the air gas comprising ionized air is used. It is preferable that an ion generating unit for producing the ionized air be positioned as near as possible to an air ejection nozzle slit, but the ion generating unit may be disposed within a hose-pipe or a duct system which connects an air blower and the air ejection nozzle slit to produce the above-mentioned effect.

It is preferable that the air gas be ejected with an ejection pressure of 3 to 200 mmaq. As long as the ejection pressure for the air gas is within this range, even if such a thin printing substrate with a thickness of about 2 to 20 $\mu$m as for a thermosensitive recording ribbon and a sublimation-type ink ribbon is employed, the printing substrate does not vibrate, so that the occurrence of the misting of the printing ink can be effectively prevented, and high printing quality can be secured. When the ejection pressure exceeds 200 mmaq, there is the risk that the printing substrate vibrates.

In the present invention, when the gas or air is ejected from the nozzle slit, there is formed a vena contracta zone with such a length that is about 5 times, or at most about 8 to 10 times, the slit gap of the nozzle slit. In such a vena contracta zone, the dynamic energy of the gas can be effectively used. However, beyond the vena contracts zone, the gas diffuses, so that the dynamic pressure of the air does not perform a cutting function out of the vena contracta zone.

Figure 2:
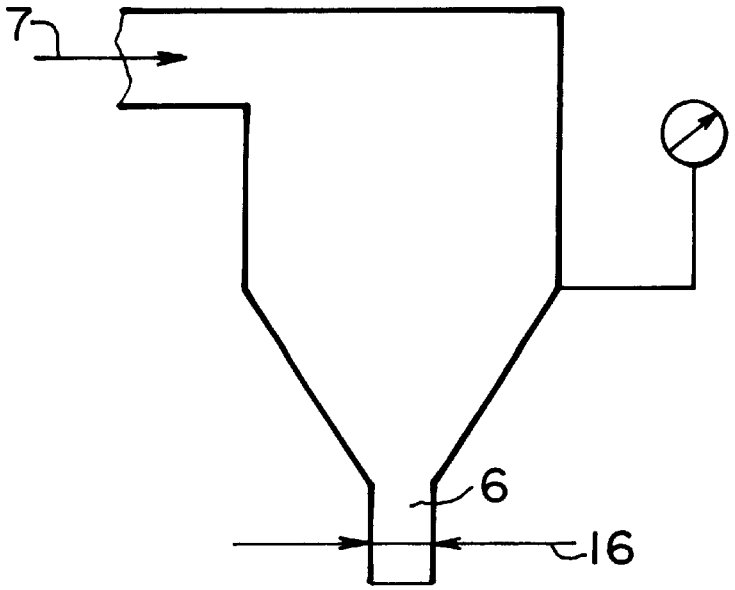
FIG. 2 is a schematic cross-sectional side view of an air supply nozzle of the rotary screen printing machine shown in FIG. 1, serving as a gas ejection slit.
Figure 3:
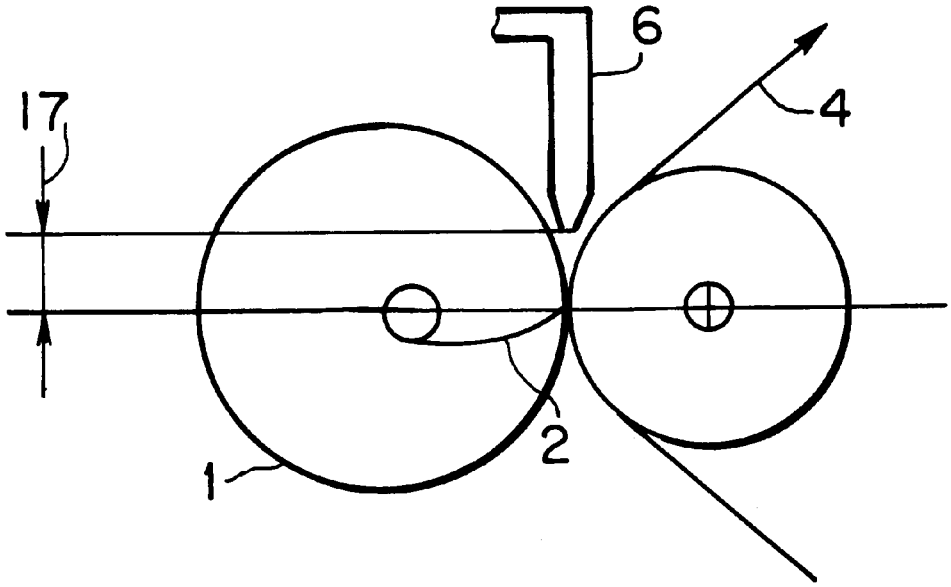
FIG. 3 is a schematic cross-sectional side view of a top end portion of the air supply nozzle, a rotary screen, and a printing substrate in explanation of the distance between (a) the top end portion of the air supply nozzle and (b) a contact point of the rotary screen with the printing substrate.

The misting of the printing ink can be reduced when a slit gap 16 of the nozzle slit as shown in FIG. 2 is set at 0.3 to 5 mm in order to dispose the nozzle slit as near as possible to the separating portion, with the effects of the curvature of the outer peripheral surface of each of the rotary screen plate and the back-up roller on the misting of the printing ink taken into consideration, and also when a distance 17 between (a) the top end of the nozzle slit and (b) the contact point of the rotary screen plate 1 with the printing substrate 4 is set in a range of 14 mm to 50 mm in order that the distance 17 substantially comes in the vena contracta zone of the ejection of the gas as shown in FIG. 3.

The screen printing machine of the present invention is capable of significantly reducing the misting of the printing ink and smoothing the surface of the solid ink transferred portion on the printing substrate 4.

Furthermore, in the screen printing machine of the present invention, the misting of the printing ink can be further reduced by ejecting a mixed gas comprising ionized air from the printing outlet portion thereof.

Other features of this invention will become apparent in the course of the following description of exemplary embodiments, which are given for illustration of the invention and are not intended to be limiting thereof.

EXAMPLE 1

Screen printing was performed using the screen printing machine of the present invention under the following conditions:

Outer diameter of the rotary screen: 203 mm

Thickness of the rotary screen plate: 100 μm

Mesh size of the rotary screen: 135 mesh

Printing pattern: rectangular solid image pattern (25 mm×204 mm)

Outer diameter of the back-up roller: 200 mm

Printing substrate: 12 μm thick polyester film

Tension applied to the printing substrate: 3 kg/300 mm width

Printing ink: Alcohol solvent based ink with a solid component content of 30 wt. % and a viscosity of 23,000 mPa.s Printing speed (transportation . . . line speed of the printing substrate): 10 m/min Opening gap size of the air ejection nozzle slit: 2 mm Air ejection pressure: 50, 100, 150, 200 mmaq Distance between (a) the top end of the nozzle slit and (b) the contact point of the screen plate with the printing substrate: 17 mm Thickness of the printed layer: 5 μm Air was ejected toward the separating portion at which the printing substrate separated from the outer surface of the rotary screen, with the air ejection pressure set at 50, 100, 150 and 200 mmaq, to observe the maximum filtered waviness (WCM μm) of the printed coated surface of the printing substrate, as defined in Japanese Industrial Standard (JIS) B 0610-1987.

The results are as shown in TABLE 1. As indicated in TABLE 1, when the air ejection pressure was increased to 200 mmaq, the rotary screen plate began to be vibrated.

COMPARATIVE EXAMPLE 1

Screen printing was performed under the same conditions as in Example 1 except that the air ejection was not conducted. The result is shown in TABLE 1.

TABLE 1

| Example 1 | | | | Comparative Example 1 |
|---|---|---|---|---|
| Air Ejection Pressure 50 mmaq | Air Ejection Pressure 100 mmaq | Air Ejection Pressure 150 mmaq | Air Ejection Pressure 200 mmaq | Air Ejection Pressure zero (0) mmaq |
| $W_{CM}$ 2.0 μm | $W_{CM}$ 1.7 μm | $W_{CM}$ 1.6 μm | $W_{CM}$ 1.6 μm (Rotary screen pattern plate vibrated) | WCM 2.2 μm |

EXAMPLE 2

Screen printing was performed under the same conditions as in Example 1 except that the printing ink employed in Example 1 was replaced by the following printing ink, and that the printing speed in Example 1 was changed as follows, to investigate the number of smeared spots in 4 printing patterns by the misting of the printing ink employed:

Printing ink: Alcohol solvent based ink with a solid component content of 27 wt. % and a viscosity of 15,000 mPa.s Printing speed (transportation line speed of the printing substrate): 20 m/min The results are shown in TABLE 2.

COMPARATIVE EXAMPLE 2

Screen printing was performed under the same conditions as in Example 2 except that the air ejection toward the separating portion conducted in Example 2 was not carried out, to investigate the number of smeared spots in 4 printing patterns by the misting of the printing ink employed.

The results are shown in TABLE 2.

TABLE 2

| | Air Ejection Pressure (mmaq) | Number of smeared spots |
|---|---|---|
| Example 2 | 5 | 2 |
| | 50 | 1 |
| | 200 | 1 |
| | 225 | (Printing was impossible to be conducted due to the vibrations of the printing substrate and the screen printing plate.) |
| Comp. Example 2 | Zero (0) | 161 |

REFERENCE EXAMPLE 1

Screen printing was performed under the same conditions as in Example 2 except that air suction was conducted at a suction pressure of 15 mmaq and at a suction pressure of 50 mmaq instead of the air ejection toward the separating portion conducted in Example 2 to investigate the number of smeared spots in 4 printing patterns by the misting of the printing ink employed.

The results are shown in TABLE 3 in which the results of the above Comparative Example 2 are also shown for comparison with the results of Reference Example 1.

TABLE 3

| | Air Suction Pressure (mmaq) | Number of smeared spots |
|---|---|---|
| Reference Example 1 | 15 | 18 |
| | 50 | 17 |
| Comp. Example 2 | Zero (0) | 161 |

EXAMPLE 3

Screen printing was performed under the same conditions as in Example 2 except that the air employed in Example 2 was ionized, using a commercially available electrostatic eliminating device (Trademark "SR-2" made by Shinko Company, Ltd.) with a width of 300 mm, serving as an ionized air generation and supplying apparatus, set in the air nozzle slit, with air supplying thereto, to investigate the number of smeared spots in 4 printing patterns by the misting of the printing ink employed.

The results are shown in TABLE 4 in which the results of the above Example 2 are also shown for comparison with the results of Example 3.

TABLE 4

| | Air Ejection Pressure (mmaq) | Number of smeared spots |
|---|---|---|
| Example 2 | 5 | 2 |
| Example 3 | (ionized air) 5 | 0 |

EXAMPLE 4

Screen printing was performed under the same conditions as in Example 1 except that the printing ink employed in Example 1 was replaced by the following printing ink, and that the air ejection pressure in Example 1 was changed as follows, to investigate the waviness of the printed surface:

Printing ink: Alcohol solvent based ink with a solid component content of 22 wt. % and a viscosity of 2500 mPa.s Air ejection pressure; 100 mmaq The waviness of the printed surface was 1.4 $\mu$m in terms of WCM.

Japanese Patent Application No. 09-289239 filed Oct. 7, 1997 is hereby incorporated by reference.

What is claimed is:

1. A screen process printing method of performing solid printing on a printing substrate with a printing ink, using (a) a squeegee, (b) a screen pattern plate through which said printing ink is brushed or squeezed so as to form a solid ink transferred portion on said printing substrate by said squeegee which is in contact with said screen pattern plate, with said screen pattern plate coming into contact with said printing substrate and separating therefrom, (c) a back-up roller which is disposed so as to be directed to said screen pattern plate and said squeegee, and around which said printing substrate is wound, and (d) a gas ejection slit from which a gas is ejected, comprising a step of ejecting said gas from said gas ejection slit toward a separation portion at which said printing substrate separates away from said screen pattern plate, thereby smoothing the surface of said solid ink transferred portion on said printing substrate, wherein said printing ink is electrostatically chargeable, and further comprising a step of electrically neutralizing said printing ink when said printing substrate is separated away from said screen pattern plate.

2. A screen process printing method of performing solid printing on a printing substrate with a printing ink, using (a) a squeegee, (b) a screen pattern plate through which said printing ink is brushed or squeezed so as to form a solid ink transferred portion on said printing substrate by said squeegee which is in contact with said screen pattern plate, with said screen pattern plate coming into contact with said printing substrate and separating therefrom, (c) a back-up roller which is disposed so as to be directed to said screen pattern plate and said squeegee, and around which said printing substrate is wound, and (d) a gas ejection slit from which a gas is ejected, comprising a step of ejecting said gas from said gas ejection slit toward a separation portion at which said printing substrate separates away from said screen pattern plate, thereby smoothing the surface of said solid ink transferred portion on said printing substrate, wherein said printing ink is electrostatically chargeable, and wherein said gas includes an ionized component capable of electrically neutralizing said printing ink when said printing substrate is separated away from said screen pattern plate.

3. A screen process printing method of performing solid printing on a printing substrate with a printing ink, using (a) a squeegee, (b) a screen pattern plate through which said printing ink is brushed or squeezed so as to form a solid ink transferred portion on said printing substrate by said squeegee which is in contact with said screen pattern plate, with said screen pattern plate coming into contact with said printing substrate and separating therefrom, (c) a back-up roller which is disposed so as to be directed to said screen pattern plate and said squeegee, and around which said printing substrate is wound, and (d) a gas ejection slit from which a gas is ejected, comprising a step of ejecting said gas from said gas ejection slit toward a separation portion at which said printing substrate separates away from said screen pattern plate, thereby smoothing the surface of said solid ink transferred portion on said printing substrate, wherein said printing ink is subject to clogging said screen plate by drying and wherein said gas includes a component capable of preventing the drying of said printing ink.

4. The screen process printing method as claimed in claim 3, wherein said component capable of preventing the drying of said printing ink comprises at least one component selected from the group consisting of a vaporized organic solvent, an aqueous vapor, and a mixture thereof.

5. A screen printing machine for performing solid printing on a printing substrate with a printing ink, comprising:

a squeegee, a screen pattern plate through which said printing ink is brushed or squeezed so as to form a solid ink transferred portion on said printing substrate by said squeegee which is in contact with said screen pattern plate, with said screen pattern plate coming into contact with said printing substrate and separating therefrom, a back-up roller which is disposed so as to be directed to said screen pattern plate and said squeegee, and around which said printing substrate is wound, and a gas ejection slit from which a gas is ejected toward a separation portion at which said printing substrate separates away from said screen pattern plate, thereby smoothing the surface of said solid ink transferred portion on said printing substrate, wherein said printing ink is electrostatically chargeable, and further comprising an ion generator which is capable of ionizing at least part of said gas ejected from said gas ejection slit, or generating an ionized component in said gas, thereby electrically neutralizing said printing ink when said printing substrate is separated away from said screen pattern plate.

6. A screen printing machine for performing solid printing on a printing substrate with a printing ink, comprising:

a squeegee, a screen pattern plate through which said printing ink is brushed or squeezed so as to form a solid ink transferred portion on said printing substrate by said squeegee which is in contact with said screen pattern plate, with said screen pattern plate coming into contact with said printing substrate and separating therefrom, a back-up roller which is disposed so as to be directed to said screen pattern plate and said squeegee, and around which said printing substrate is wound, and a gas ejection slit from which a gas is ejected toward a separation portion at which said printing substrate separates away from said screen pattern plate, thereby smoothing the surface of said solid ink transferred portion on said printing substrate, wherein said printing ink is electrostatically chargeable, and wherein said gas includes an ionized component capable of electrically neutralizing said printing ink when said printing substrate is separated away from said screen pattern plate.

7. A screen printing machine for performing solid printing on a printing substrate with a printing ink, comprising:

a squeegee, a screen pattern plate through which said printing ink is brushed or squeezed so as to form a solid ink transferred portion on said printing substrate by said squeegee which is in contact with said screen pattern plate, with said screen pattern plate coming into contact with said printing substrate and separating therefrom, a back-up roller which is disposed so as to be directed to said screen pattern plate and said squeegee, and around which said printing substrate is wound, and a gas ejection slit from which a gas is ejected toward a separation portion at which said printing substrate separates away from said screen pattern plate, thereby smoothing the surface of said solid ink transferred portion on said printing substrate, wherein said printing ink is subjected to clogging said screen plate by drying and wherein said gas includes a component capable of preventing the drying of said printing ink.

8. The screen printing machine as claimed in claim 7, wherein said component capable of preventing the drying of said printing ink comprises at least one component selected from the group consisting of a vaporized organic solvent, an aqueous vapor, and a mixture thereof.

* * * * *